US005964369A

United States Patent [19]

Greene et al.

[11] Patent Number: 5,964,369

[45] Date of Patent: Oct. 12, 1999

[54] MOBILE COLLAPSIBLE FLOATING OIL CONTAINER

[75] Inventors: Boyd Greene; Naji Nassif, both of Memphis, Tenn.

[73] Assignee: Gnesys, Inc., Memphis, Tenn.

[21] Appl. No.: 09/051,310

[22] PCT Filed: Oct. 18, 1996

[86] PCT No.: PCT/US96/16785

§ 371 Date: Apr. 3, 1998

§ 102(e) Date: Apr. 3, 1998

[87] PCT Pub. No.: WO97/14622

PCT Pub. Date: Apr. 24, 1997

Related U.S. Application Data

[60] Provisional application No. 60/006,027, Oct. 18, 1995.

[51] Int. Cl.[6] ..... B65D 33/00

[52] U.S. Cl. ..... 220/560; 220/666

[58] Field of Search ..... 220/560, 666, 220/4.12

[56] References Cited

U.S. PATENT DOCUMENTS

| | | | |
|---|---|---|---|
| 2,655,888 | 10/1953 | Alcorn | 220/560 X |
| 2,915,097 | 12/1959 | Lewis | 220/666 X |
| 2,916,058 | 12/1959 | Unthank | 220/666 X |
| 2,931,409 | 4/1960 | Unthank | 220/666 |
| 3,016,938 | 1/1962 | Akrep | 220/666 X |
| 3,889,477 | 6/1975 | Tam . | |
| 4,223,536 | 9/1980 | Ross et al. . | |
| 4,927,041 | 5/1990 | Hepburn . | |
| 5,080,783 | 1/1992 | Brown | 220/560 X |

*Primary Examiner*—Steven Pollard
*Attorney, Agent, or Firm*—Londa and Traub LLP

[57] ABSTRACT

This invention relates to a flexible, collapsible, floating container (1) for receiving and holding liquids such as oil recovered from oil spills. Specifically, the invention relates to a continuous, sealed, collapsible container having an upper portion which has a positivebuoyancy to maintain an upright position of the container while collapsed and when filled with oil. A rigid ring (2) with a valve (4) for introducing the liquid is located in the upper portion. A stabilizer to prevent rotation and provide stability may be attached to a lower portion of the container. A strengthening layer, such as nylon mesh (16) could be added to surround the container (1), as well as a harness for lifting the container out of the water. The container (1) expands and floats as it becomes filled.

20 Claims, 2 Drawing Sheets

MOBILE COLLAPSIBLE FLOATING OIL CONTAINER

This application claims benefit of provisional Appl. No. 60/006,027 filed Oct. 18, 1995.

The invention relates to a collapsible floating container for receiving and holding liquids. In particular, the invention relates to a container for holding oil pumped from an oil slick on a body of water.

BACKGROUND

In attempting to contain and remove oil floating on a body of water, i.e., an oil slick, there is presently a problem associated with holding and then removing the oil from the site once it has been removed from the surface of the water. Currently, the oil is simply pumped into waiting barges. However, it can be costly, difficult and time-consuming to gather and deploy a sufficient number of barges on short notice. To overcome this problem, the present inventors have now devised a system utilizing a large number of easily transportable, rapidly deployable, lightweight, collapsible oil containers.

DETAILED DESCRIPTION

Figure 1:
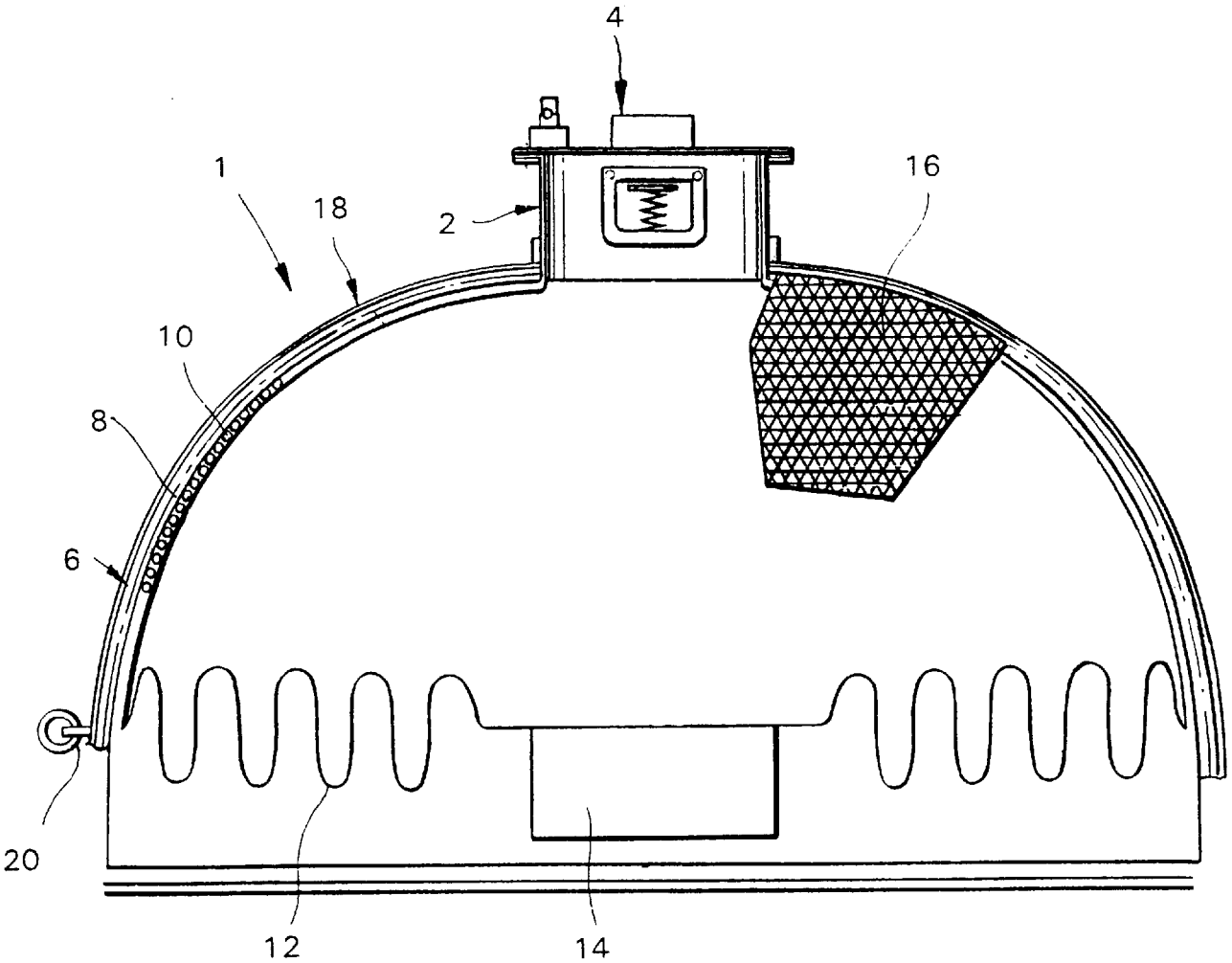
FIG. 1 shows a container of the invention in partial cross-section in a collapsed state before being filled with oil.

FIG. 1 shows a container of the invention in partial cross-section in a collapsed state before being filled with oil. A rigid ring 2 is located at the top end of the container 1, substantially in the center of a buoyant, upper portion, and contains a valve 4. The ring and valve operate to connectingly and sealingly receive a hose or pipe through which the incoming oil is passed. The valve 4 could be any valve of known construction capable of receiving a hose or pipe, and which forms a seal. It could be, for example, a ball valve or a one-way flapper which is mechanically opened by the force of the oil or other liquid being pumped into the container. The valve could also be spring loaded to check reverse flow, or be designed to open mechanically by the force of the hose or pipe itself.

The remaining body portion 6 of the container is flexible and collapsible. It may be constructed of any buoyant, non-permeable material, but it must be resistant to degradation or chemical interaction between itself and the oil or other liquid intended to be pumped into the container. As a preferred embodiment, the body portion would be a reinforced rubber material, having a thickness of approximately 0.060 inches. Alternatively, the body portion could be disposable by using an inexpensive plastic material. The material must also have sufficient strength to maintain the integrity of the container in a filled state, and when the container is eventually removed from the water to empty the contents.

With this in mind, the body portion 6 may comprise an upper portion 8 composed of a buoyant skin which causes the container to float near the surface of the water. The buoyant skin can be achieved by providing, e.g., a plastic or rubber sheet interspersed with a plurality of small air-containing pockets or cells 10, such as that found commonly in "bubble wrap." Additional materials may be used to provide bouyancy, such as styrofoam, foam rubber, or other material having a density substantially less than that of fresh or salt water. The buoyant skin should provide sufficient buoyancy to the container when full to maintain approximately one-third of the container above the water level. This is particularly important when the oil or liquid used to fill the container has a density greater than the water in which the container must float, whether it is fresh water or salt, sea water.

The strength of the upper portion may be reinforced by the addition of another layer. As shown in FIG. 1, the additional layer, preferably a nylon mesh layer 16 surrounds the upper portion, and could be either permanently fixed or made to be removable. This would depend on the material chosen for the body portion and whether it is intended that the body portion would be disposable. The preferred embodiment shown in FIG. 1 illustrates reinforcing layer 16 to be outside buoyant layer 10, which in turn covers the body portion 6.

In order to lift the container once it has been filled completely with oil, the container may be provided with a support harness 18 removably surrounding the body portion. The support harness 18 may consist of a series of flexible interconnecting belts surrounding the container and fitted with a series of hooks 20. Also, the support harness could be constructed integrally with the nylon mesh or other reinforcement material, and be provided thereby in a single covering or layer.

The lower portion 12 of the body portion 6 is formed, e.g., by a regular (i.e. non-buoyant) plastic or rubber flexible sheet, and in any case should be less buoyant in comparison to the upper portion 8. Where a separate buoyant layer is provided surrounding the upper body portion, the lower portion could be of the same material as used for the upper portion. In this embodiment, the container would comprise a continuous, internal bladder 22, extruded or manufactured from the same piece of material and not having a seam. Where the upper and lower portions are two different materials, however, the upper portion 8 and lower portion 12 of the body portion of the container are joined to provide an essentially continuous, sealed container.

Any material of sufficient flexibility to allow the container to collapse when empty, and of sufficient strength to be able to support a large weight of oil contained, may be used. Alternatively, the upper portion may be a semi-flexible (or semi-rigid) material, such that the upper portion maintains the shape of the container, even while empty. Then, in the collapsed state the lower flexible portion or bladder folds into the upper portion, which is not totally collapsible into a "flat" configuration, but holds the upper shape of the container. FIG. 1 shows a container that forms a sphere when filled, but a container of almost any shape could be constructed. However, the filled container should be of such a design that it will maintain stability in water and remain upright, keeping the valve at the top. FIG. 1 also illustrates that the upper portion maintains the overall shape of the container when it is made of semi-flexible material.

In order to maintain stability and prevent uncontrolled rotation of the container, a rigid stabilizer 14 is attached to the underside of the lower portion. Ideally, the stabilizer may be of planar construction and located substantially in the center of the container, aligned about a vertical axis. However, other stabilizer configurations may accomplish the desired effect.

Figure 2:
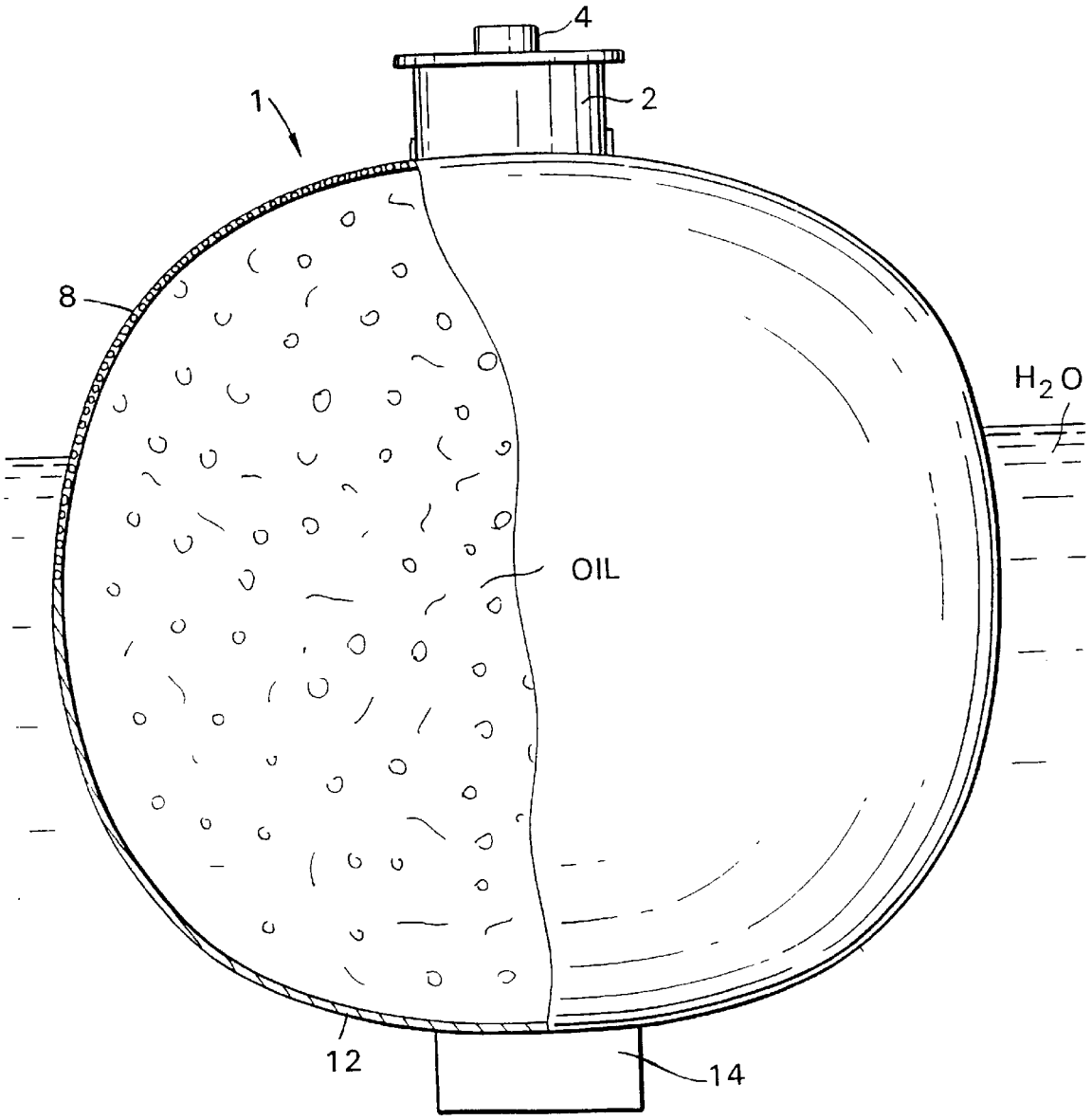
FIG. 2 shows the container in an expanded state filled with oil.

FIG. 2 shows the container when filled with oil. The buoyancy of the upper portion causes the container to float on the surface of the water in the proper upright position with the ring and valve reaching out of the water. The weight of the oil within the container pulls down on the lower portion. The generally rigid stabilizer 14 is shown extending from the bottom of the container to maintain stability within the water. The container may advantageously be surrounded by a removable support 16, e.g., a nylon netting, to reinforce the strength of the container.

Oil from an oil slick is collected with an oil boom and pumped into the waiting containers. Once filled, each container may then be lifted out of the water by way of the hook and harness system, and emptied into a suitable receptacle. The container is then removed from the harness and support netting, which are reused with a new container.

It will be appreciated that various departures and modifications can be made to the foregoing container by those knowledgeable in the art without departing from the spirit of the invention, and that certain changes and modifications may be practiced within the scope of the appended claims.

We claim:

1. A collapsible floating container for receiving and holding liquids, comprising;

a flexible, buoyant upper portion having an upper and a lower surface and a perimeter, a flexible lower portion also having a perimeter and a buoyancy less than that of the upper portion, a rigid ring located substantially in the center of the upper buoyant portion, having a valve for connectingly and sealingly receiving a hose or pipe fitting, and wherein the buoyant upper portion is sealingly joined along its perimeter to the perimeter of the lower portion to form a body portion, and provides a buoyancy sufficient to cause the container to float when in an unfilled, collapsed state, and the lower portion operates as a ballast to keep the container in an upright position when in a partially or fully filled state and to keep the rigid ring and valve at the top of the container, and wherein the addition of a liquid through the valve while the container is in the collapsed state causes the container to expand to a filled state in which the container remains floatable and in a stable, upright position.

2. The container according to claim 1 wherein the flexible upper and lower portions are constructed of materials that are chemically resistant to the liquid to be added to the container.

3. The container according to claim 2, wherein the upper portion further comprises a separate buoyant layer.

4. The container according to claim 3, wherein the separate, buoyant layer further comprises a plurality of small, air-containing pockets.

5. The container according to claim 2, further comprising means for lifting the filled container.

6. The container according to claim 5, wherein the means for lifting the container comprises a support harness removably surrounding the body portion of the container.

7. The container according to claim 6, further comprising means for reinforcing the strength of the body portion of the container.

8. The container according to claim 7, wherein the reinforcing means comprises nylon netting removably surrounding the body portion.

9. The container according to claim 6, wherein the support harness further comprises a series of flexible interconnecting belts surrounding the container and fitted with a series of hooks.

10. The container according to claim 9 wherein the flexible interconnecting belts are incorporated into the reinforcement means.

11. The container according to claim 2, wherein the buoyant upper portion has a buoyancy sufficient to maintain the container floating and in an upright position even when the container is filled with liquid having a density greater than the water in which the container floats.

12. The container according to claim 1, further comprising a stabilizer extending from the lower portion to provide stability of the container within the water.

13. The container according to claim 12, wherein the stabilizer extends downward along a vertical axis from substantially near the center of the lower portion.

14. The container according to claim 13 wherein the stabilizer is in the form of a rudder.

15. The container according to claim 1, wherein the upper portion is semi-flexible which maintains, in the upper portion, the shape of the container while in an empty state.

16. A collapsible floating container for receiving and holding liquids, comprising;

a body portion having a flexible, buoyant upper portion joined to a flexible lower portion having a buoyancy less than the upper portion, forming a continuous, sealed container, and further comprising a rigid ring located substantially in the center of the upper buoyant portion, having a valve for connectingly and sealingly receiving a hose or pipe fitting, a stabilizer extending downward along a vertical axis from the lower portion to provide stability of the container within the water, support means to aide in removing the container from the water when filled, and wherein the upper portion is sufficiently buoyant to float the container in an upright position when filled with liquid, even if the liquid has a density greater than the water in which the container floats.

17. A collapsible floating container for receiving and holding liquids, comprising;

a flexible, continuous, single-piece body portion in the form of a bladder having an upper surface and a lower surface, constructed of a materials that is chemically resistant to a liquid to be added to the container, a buoyant upper portion as a separate layer removably covering the upper surface of the body portion, a rigid ring located substantially in the center of the upper surface of the body portion, having a valve for connectingly and sealingly receiving a hose or pipe fitting, and wherein the buoyant upper portion provides a buoyancy sufficient to cause the container to float when in an unfilled, collapsed state, and to maintain the container floating and in an upright position even when the container is filled with liquid having a density greater than the water in which the container floats and to keep the rigid ring and valve at the top of the container, and wherein the addition of a liquid through the valve while the container is in the collapsed state causes the container to expand to a filled state in which the container remains floatable and in a stable, upright position.

18. The container according to claim 17, wherein the buoyant, upper portion further comprises a plurality of small, air-containing pockets.

19. The container according to claim 17, further comprising stabilizing means extending from the lower surface of the body portion.

20. The container according to claim 19, further comprising means for lifting the filled container and means for reinforcing the strength of the body portion of the container.

* * * * *